US009850647B1

(12) United States Patent
Coppes et al.

(10) Patent No.: US 9,850,647 B1
(45) Date of Patent: Dec. 26, 2017

(54) TWO PIECE PLASTIC STORMWATER CHAMBER HAVING LOCKING ROD

(71) Applicants: Bryan A. Coppes, Old Saybrook, CT (US); Paul R. Holbrook, Old Saybrook, CT (US)

(72) Inventors: Bryan A. Coppes, Old Saybrook, CT (US); Paul R. Holbrook, Old Saybrook, CT (US)

(73) Assignee: INFOLTRATOR WATER TECHNOLOGIES LLC, Old Saybrook, CT (US)

( * ) Notice: Subject to any disclaimer, the term of this patent is extended or adjusted under 35 U.S.C. 154(b) by 0 days.

(21) Appl. No.: 14/694,662

(22) Filed: Apr. 23, 2015

Related U.S. Application Data

(63) Continuation-in-part of application No. 14/025,782, filed on Sep. 12, 2013, now Pat. No. 9,016,979, and a continuation-in-part of application No. 14/025,773, filed on Sep. 12, 2013, now Pat. No. 9,233,775.

(60) Provisional application No. 61/700,313, filed on Sep. 12, 2012, provisional application No. 61/700,315, filed on Sep. 12, 2012.

(51) Int. Cl.
*F16L 9/22* (2006.01)
*E03F 1/00* (2006.01)

(52) U.S. Cl.
CPC ..... *E03F 1/003* (2013.01)

(58) Field of Classification Search
USPC ..... 210/170.01, 170.03, 170.08
See application file for complete search history.

(56) References Cited

U.S. PATENT DOCUMENTS 770,236 A * 9/1904 Lauridtzen ..... F16L 9/22 138/157
2,286,197 A * 6/1942 Claybaugh ..... B21D 53/00 138/145
3,440,823 A * 4/1969 Olsen ..... E02B 11/005 405/43
3,583,424 A * 6/1971 Bryant ..... E02B 13/00 138/121
3,681,925 A * 8/1972 Schmunk ..... E02B 11/005 138/121
3,818,948 A * 6/1974 Hedges ..... F24F 13/0272 138/119
4,245,924 A * 1/1981 Fouss ..... B29C 65/02 138/119
4,266,578 A * 5/1981 Swain ..... E21B 17/105 138/110
4,386,919 A * 6/1983 Kadono ..... F16L 1/24 285/419

(Continued)

*Primary Examiner* — Tara M. Pinnock
(74) *Attorney, Agent, or Firm* — C. Nessler

(57) ABSTRACT

A molded plastic arch shape cross section stormwater chamber having a corrugated wall comprises separately molded half chambers which are connected by coupling features at a joint region at the top of the chamber, which coupling feature optionally includes at least one locking rod running lengthwise in proximity to the joint region. Preferably, the half chambers are made in the same mold and modified so they are mirror images of each other. The half chambers may be compactly stored and transported in nested condition. Near the point of use, the chambers may be assembled.

17 Claims, 9 Drawing Sheets

(56) References Cited

U.S. PATENT DOCUMENTS 4,535,822 A * 8/1985 Rogers, Jr. ..... F16L 55/17 138/99
4,541,256 A * 9/1985 Green ..... F16B 41/005 16/386
4,615,543 A * 10/1986 Cannon ..... F16L 35/00 166/241.4
4,796,670 A * 1/1989 Russell ..... F16L 57/00 138/108
5,592,975 A * 1/1997 Wissmann ..... F16L 7/00 138/112
6,293,722 B1 * 9/2001 Holbrook ..... B42F 13/26 402/26
6,488,053 B1 * 12/2002 Tadokoro ..... H02G 3/0468 138/110
6,938,645 B2 * 9/2005 Domingues Duarte ..... B29C 47/0023 138/110
8,672,583 B1 * 3/2014 Mailhot ..... E02B 11/005 405/42
8,740,005 B1 * 6/2014 Holbrook ..... B65D 88/06 220/4.13
8,789,714 B1 * 7/2014 Kruger ..... E03F 11/00 210/532.2
8,857,641 B1 * 10/2014 Moore, Jr. ..... B65D 88/06 220/4.12
2002/0132706 A1 * 9/2002 Sleamaker ..... A63B 21/068 482/51
2004/0237632 A1 * 12/2004 Van Keeken ..... F16L 23/003 73/46
2007/0066451 A1 * 3/2007 Gruben ..... A63B 24/00 482/92
2009/0220302 A1 * 9/2009 Cobb ..... E03F 1/003 405/49
2009/0232600 A1 * 9/2009 Kim ..... E03F 1/003 405/43
2009/0302601 A1 * 12/2009 Sarkisyan ..... F16L 21/005 285/337
2011/0200391 A1 * 8/2011 Mailhot ..... E03F 1/003 405/42
2015/0211198 A1 * 7/2015 Mailhot ..... E03F 1/003 405/49

* cited by examiner

TWO PIECE PLASTIC STORMWATER CHAMBER HAVING LOCKING ROD

This application is a continuation in part of both patent application Ser. No. 14/025,782, filed Sep. 12, 2013, now U.S. Pat. No. 9,016,979, and patent application Ser. No. 14/025,773, filed Sep. 12, 2013. This application claims benefit of both provisional application Ser. No. 61/700,313, filed Sep. 12, 2012, and provisional application 61/700,315, filed on Sep. 12, 2012. The disclosure of each of the foregoing patent applications is hereby incorporated by reference.

TECHNICAL FIELD

The present invention relates to molded plastic chambers having arch shape cross sections, for receiving, containing and dispersing stormwater when buried beneath the surface of the earth.

BACKGROUND

Arch shape cross section storm chambers made from injection molded plastics have been used for a number of years to handle stormwater. In a typical installation, multiple rows of strings of interconnected chambers are placed on the floor of a cavity made in the earth surface and are then backfilled with crushed stone or the like. Stormwater, such as might run-off from a paved parking lot or roofs of buildings is channeled to the chambers so the waters can accumulate and then be dispersed over time by either percolation into the surrounding soil or by controllably flowing to a water course.

Some types of arch shape cross section chambers, exemplified by a corrugated chamber described in Detullio U.S. Pat. No. 5,087,151, have closed ends and are interconnected by pipes. Those chambers might be made by thermoforming of thermoplastic sheet. Another type of chamber, of more relevance to the invention described herein, is exemplified by the chambers shown in Kruger U.S. Pat. No. 7,118,306. Those kinds of chambers are preferably made by injection molding. The chambers have open ends. A string of chambers is assembled by overlapping a first end of one chamber on the second end of a like chamber, when the like chamber has been previously placed within a cavity in the earth. After installation, the chambers are backfilled, typically with crushed stone, and the stone is covered to create a soil surface, often a paved surface which can be used by motor vehicles. When so installed beneath the surface of the earth, stormwater chambers should have requisite strength and durability, particularly for bearing the overlying load of soil and any vehicular or other traffic.

Systems comprised of molded plastic arch shape cross section stormwater chambers are in functional- and cost-competition with other stormwater systems, including buried systems comprised of steel conduit and detention ponds. Generally, it is an objective to have storm chambers with larger and larger volumetric capacity per unit length, while of course still meeting the load bearing requirements. Whereas early plastic chambers used 20 years or more ago had a peak height of 12 inches, more recent chambers may be quite large. For example, a commercial Model 4500 stormwater chamber sold by Stormtech LLC, Rocky Hill, Conn. is 100 inches wide at the base, about 60 inches high, about 48 inches long, and weighs about 120 pounds. There is a generalized desire to commercialize even larger chambers.

There are practical problems encountered with large chambers. Among them are: First, it is not easy to mold large chambers because they require large molding machines and machinery for handling the just-molded products. Large and thus less common injection molding machines can be costly.

Second, large chambers present problems with respect to storing and shipping in economic fashion by truck—the most common mode. Typically chambers are nested one within the other to form a stack for shipment, typically mounted on a pallet on the bed of a truck. But because the height of each chamber is large, only a limited number of chambers can be nested upon one another in upright fashion, before the height capacity of an ordinary highway truck is exceeded. For example, if the load height capacity of a truck is about 100 inches from the bed surface, and the first or bottommost chamber is 60 inches high, then there is only about 40 inches of space for containing nested chambers. If the stack height is about 6 inches (the spacing between one chamber and next-nested chamber), then only 6 to 7 chambers can be stacked on top of the bottom chamber.

This application is a continuation in part of both patent application Ser. No. 14/025,782, filed Sep. 12, 2013, now U.S. Pat. No. 9,016,979, and patent application Ser. No. 14/025,773, filed Sep. 12, 2013, now U.S. Pat. No. 9,233,775. The disclosure of each of the foregoing patent applications is hereby incorporated by reference.

SUMMARY

An object of the invention is to provide large stormwater chambers which have improved characteristics with respect to manufacturability, shipment and handling. Another object is to provide a chamber and an associated handling and shipping method which minimizes storage and shipping costs.

In accord with the present invention, a stormwater chamber is comprised of two half chambers having coupling features, so they can be mated and joined at the top of the chamber. Half chambers of the present invention may be stacked as a nested multiplicity of half chambers on a pallet or the like for economical shipping, particularly by means of a motor vehicle transport truck. At or near the point of use, the half chambers are mated at their respective coupling features, to form a chamber which has a joint at the top of the chamber. In embodiments of the present invention, the coupling features are secured to each other by means which includes one or more of welding, fasteners, or at least one lengthwise running locking rod. Optionally, each half chamber coupling feature comprises a plurality of stirrups spaced apart by slots. When mated, the stirrups of one half chamber fit into the slots of the other half chamber to form a passageway, and a locking rod slips into the passageway. Preferably the locking rod has an eccentric shape cross section, so that it can be rotated when put in place, thereby to exert a camming action that draws the coupling features/flanges at the top of the chamber toward each other.

Different embodiments of coupling features and joints may be used. Typically the joint is comprised of mating flanges, intermittent or continuous, which run along the length of the top of the chamber. The flanges may interlock. Clamps and latching means may be used to hold the half chambers relative to each other with or without a locking rod.

The foregoing and other objects, features and advantages of the present invention will become more apparent from the following description of preferred embodiments and accompanying drawings.

DESCRIPTION

Embodiments of chambers of the present invention are preferably made of injection molded thermoplastic, preferably a polyolefin such as polyethylene or polypropylene. Optionally, other known methods of plastic forming may be used, including rotational molding, thermoforming and the like. Exemplary chambers are comprised of half chambers which join to each other by coupling means at a joint proximate the top of the chamber.

Patent application Ser. No. 14/025,773, now U.S. Pat. No. 9,233,775 describes a chamber comprised of two half chambers which are hinged at a top joint, optionally having a locking rod. Patent application Ser. No. 14/025,782, now U.S. Pat. No. 9,016,979, describes a chamber comprised of two half chambers which are mated and joined together by various means at a lengthwise top joint. Those applications respectively claim benefit of provisional patent application Ser. Nos. 61/700,315 and 61/700,313, both filed Sep. 12, 2012. The disclosures of all the foregoing applications are hereby incorporated by reference.

Figure 1:
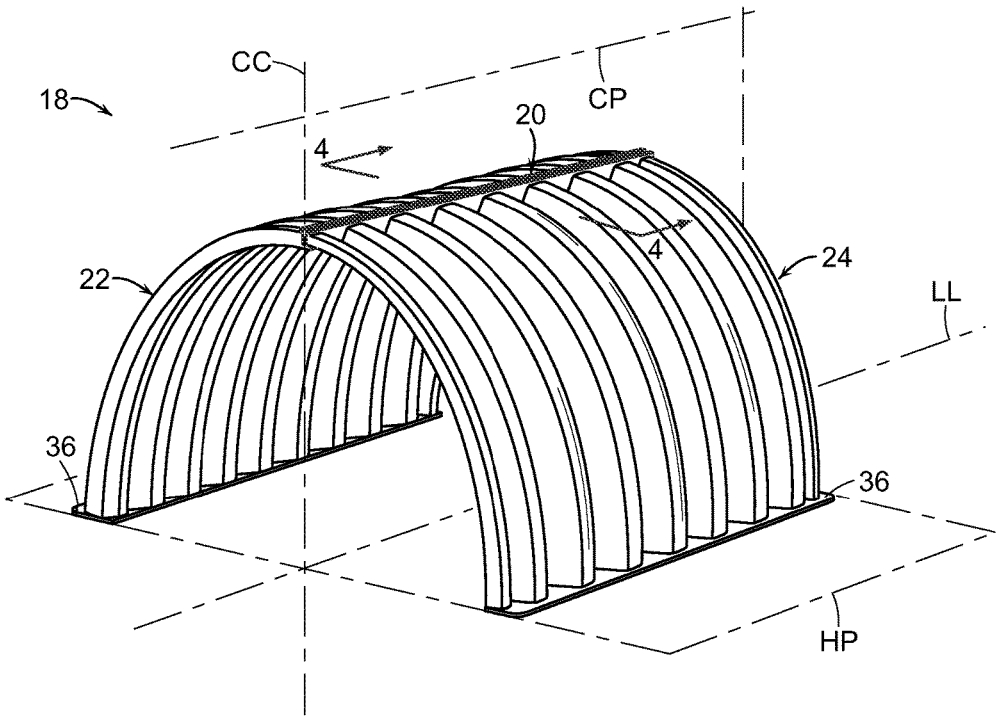
FIG. 1 is a perspective view of a stormwater chamber comprised of half chambers mated at a top joint.
Figure 2:
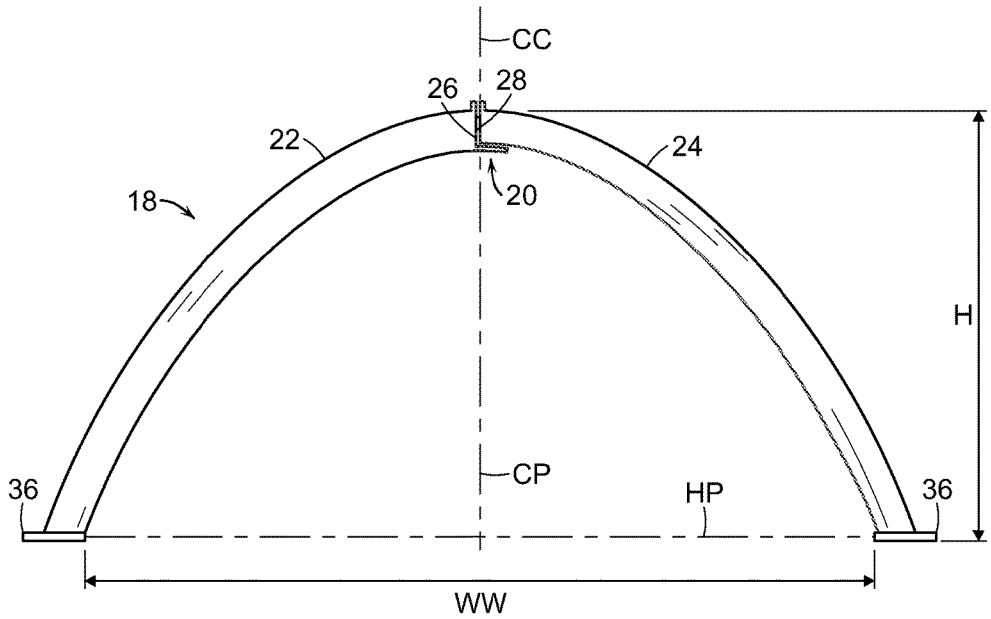
FIG. 2 is an end view of the chamber of FIG. 1.

FIG. 1 is a perspective view and FIG. 2 is an end elevation view of a chamber 18 which is comprised of two mated chamber halves 22, 24 which have a joint 20 and opposing side base flanges 36 which lie in base plane HP. Chamber 18 has a length axis LL and a vertical lengthwise center plane CP which contains a vertical axis CC, used as a reference in other Figures.

Figure 3:
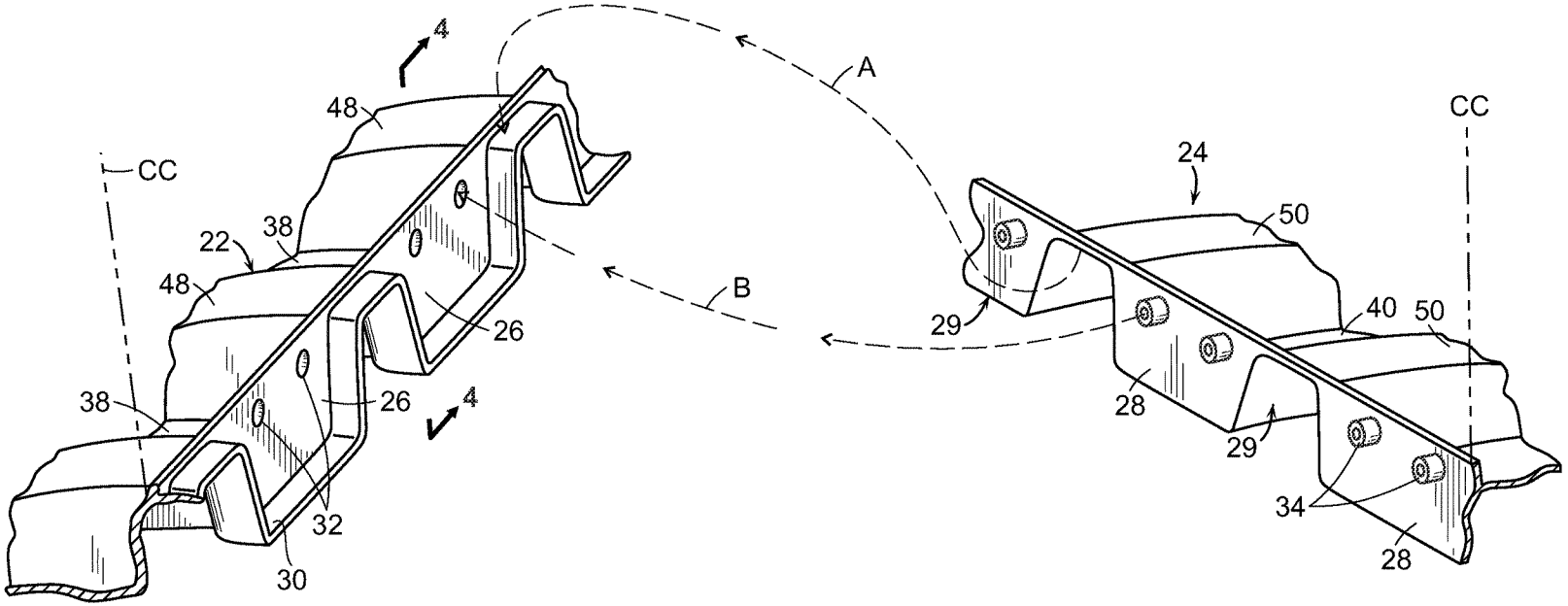
FIG. 3 is an exploded view showing the upper portions of two half chambers which comprise a chamber like that shown in FIG. 1, showing how the half chambers couple to each other at a joint at the top of the chamber.

FIG. 3 is an exploded view showing how the upper portions of exemplary half chambers 22, 24 couple together. FIGS. 4, 5, 6 and 9 are partial transverse cross section views showing features of joints of alternative embodiment chambers. An exemplary thermoplastic chamber will have a width WW of about 100 inches, a height H of about 60 inches, and a length of about 52 inches (so the effective length is 48 inches when the chambers are end to end overlapped). Alternating peak corrugations 48, 50 and valley corrugations 38, 40 run transverse to the length of the chamber. The corrugations provide cross section area for vertical load transfer and section modulus which imparts bending strength to the walls. Below, the terms "valley" and "peak" are shorthand references to the valley corrugations and peak corrugations.

Stormwater chambers and their use have been described in the art. In particular, reference may be made to commonly owned U.S. Pat. No. 7,118,306 of Kruger et al., entitled "Stormwater Management System" and U.S. Pat. No. 6,991,734 of Smith et al, entitled "Solids Retention in Stormwater System." The disclosures of the foregoing patents are hereby incorporated by reference. When a chamber is buried within crushed stone or other soil material the arch shape of the chamber cross section maintains the integrity of the interior cavity of the chamber. Simply stated, the vertical forces of the stone, soil, and anything on the surface of the soil, are transferred along the curve of the arch to the base flanges. As is characteristic of arches (for instance, arches comprised of stone or brick pieces), there need not be significant capacity to bear shear forces within the curved structure in order to maintain the integrity of the structure once it is in place and subjected to foregoing kind of vertical loads. Thus, it will be appreciated that in the present invention the joint 20 at the top of the chamber need not have strength to resist high shear load. However, a joint will desirably have sufficient shear strength to enable lifting and other handling of a chamber, to move it from the point of assembly to its position within a to-be-filled cavity in the earth or in such other water permeable substance as may be desired.

In one embodiment, half chambers are mechanically interlocked and optionally welded or otherwise secured at coupling features in vicinity of the joint. When the joint is planar it is preferably in the vertical center plane CP. When the joint is non-planar, the joint will be in proximity of the vertical center plane, with parts of the joint somewhat offset from the plane. Thus, it will be understood that each half chamber comprises about half of the whole of the arch shape wall of a chamber which runs from one base flange, to the top of the chamber, to the opposing side base flange.

FIG. 3 shows the top portions of the two half chambers 22, 24, as they appear when spaced apart and rotated away from each other to reveal the coupling features. Arrows A, B show how the half chambers 22, 24 mate with each other when the coupling surfaces are brought together to form a joint. The top of half chamber 22, on the left, has a serpentine lip 30 and a discontinuous vertical top flange 26. The flange 26 is comprised of a plurality of flat plates which close the ends of the valleys 38 that are between adjacent peak corrugations 48. The lip 30 is shaped to mate with the serpentine interior surface 29 of the half chamber 24, on the right in FIG. 3. Half chamber 24 has a top flange 28 lying in or close to the vertical plane CP which contains a vertical reference axis CC. See FIG. 1. Flanges 26, 28 may be discontinuous as shown, comprising a plurality of flat plates closing off the ends of the valleys. In an alternative embodiment, flanges 26, 28 are continuous along the length of the top of each half chamber and close the underside cavity of the peak corrugations. See FIG. 7.

When half chamber 22 and half chamber 24 are engaged with each other, the upper end of half chamber 24 rests on the surface 29 of the serpentine lip 30. Flange 28 has a multiplicity of horizontally extending pins 34 which fit into the female cavities of sockets 32 on the flange 26, to help align the coupling features with each other. The pin-socket engagements provide some shear strength to the joint.

Figure 4:
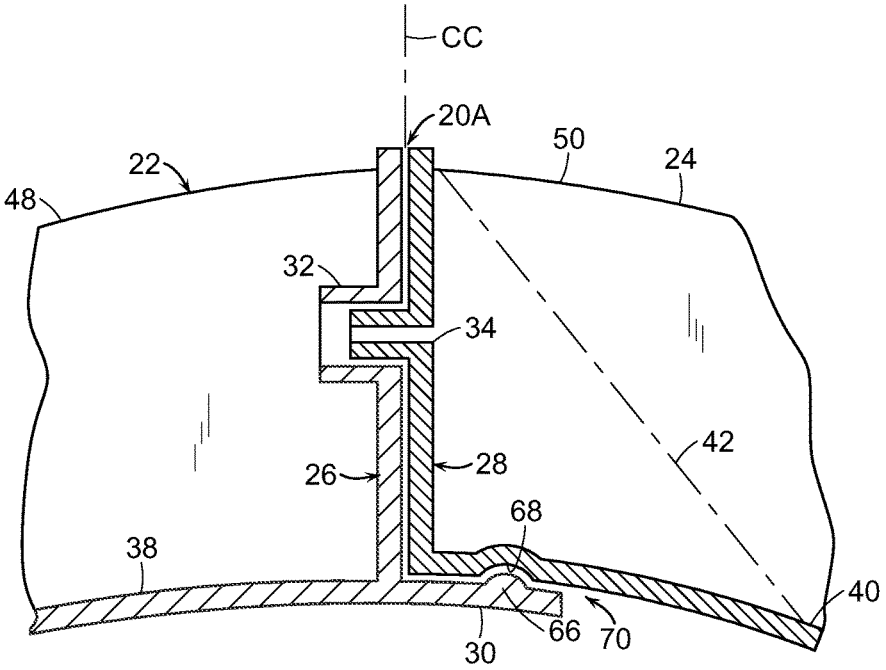
FIG. 4 is a vertical transverse cross section through the top portion of the chamber of FIG. 1.

FIG. 4 is a transverse vertical cross section showing portions of half chambers 22, 24 when they are mated to form a chamber 18 as shown in FIG. 2. The parts are shown as they are ready for welding, as by ultrasonic, heat gun, hot plate, or other known means, for example at points 70, 20A. Note how typical valley 40 of half 24 rests on lip 30 of half 22. The engagement of the vertical flange 26 on one half chamber with the vertical flange 28 on a mating half chamber is helped by pins 34 and sockets 32, or by means of substitutional functional equivalent features. The pins and socket features help locate the mating half chambers with respect to each other and also provide some vertical direction strength to the joint.

Optionally, as shown in FIG. 4, lip 30 (which has the ability to deflect elastically downwardly) may have a lengthwise ridge or a series of upward projecting protuberances 60 which are received in mating recesses 68 on the undersides of typical valleys 40, to hold modestly the half chambers together at the joint prior to welding.

The welding process mentioned above may be carried out by placement in the joint region of a fusion element such as the commercial product known as PowerCore Welding Rod (PowerCore International Ltd., Ottawa, Ontario, Canada). See also U.S. Pat. Nos. 5,407,514 and 5,407,520, the disclosures of which are hereby incorporated by reference. Alternatively, the fusion element may be the preform which is supplied as an element of the commercial Emabond electromagnetic welding system (Emabond Solutions Co., Norwood, N.J., U.S.) As described in Lamarca U.S. Pat. No. 7,984,738 (the disclosure of which is hereby incorporated by reference) the fusion element preform may be a structure comprised of plastic and magnetic particles which is energized by a high frequency induction coil to effect a weld.

While welding is preferred with the FIG. 4 joint design, it is within contemplation that chambers having joints like those shown in FIG. 4 may be useful for assembling chambers at the point of installation without adding the welding step. Other fastening or securing means may be used with the FIG. 4 embodiment, as described below.

FIG. 4 also shows one of several optional stiffeners 42 in phantom, which may be molded into the center one or more valleys 40 of typical half chamber part 24. Like stiffeners may be used on the other half 22, as well.

Figure 5:
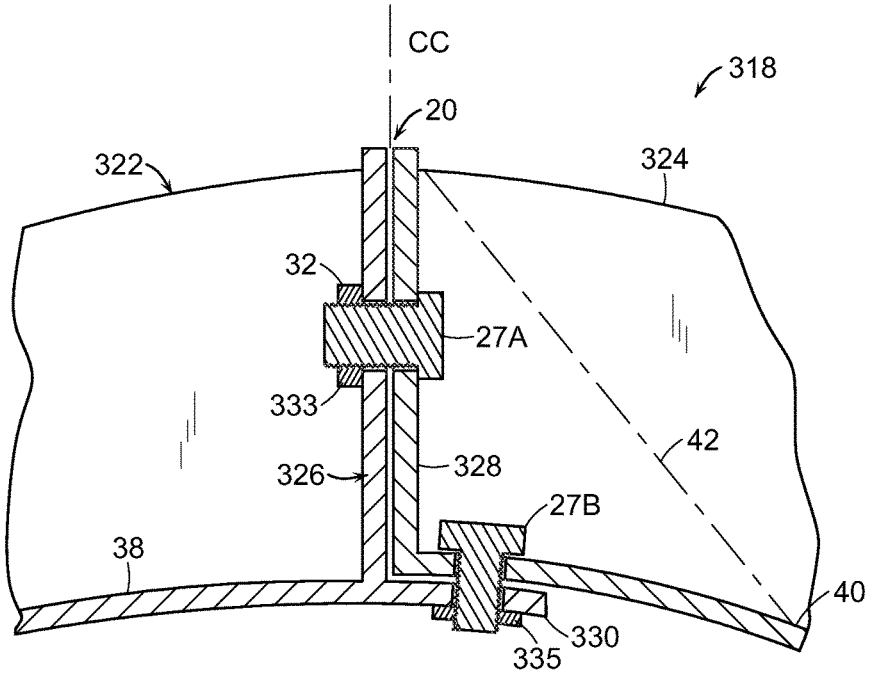
FIG. 5 is a view like FIG. 4, showing an alternative joint configuration which comprises fasteners.

FIG. 5 shows a portion of an alternate another embodiment of the invention, chamber 318, where a bolted joint 20 is formed between half chamber 322 and half chamber 324—which half chambers have configurations largely like chambers 22, 24. A multiplicity of exemplary threaded fasteners 27A, 27B inserted in holes, and associated nuts 333, 335, are used to join vertical flanges 326, 328 to each other and to join lip 330 with valley 40. Preferably, a multiplicity of fasteners will be spaced apart along the length of the joint.

Figure 6:
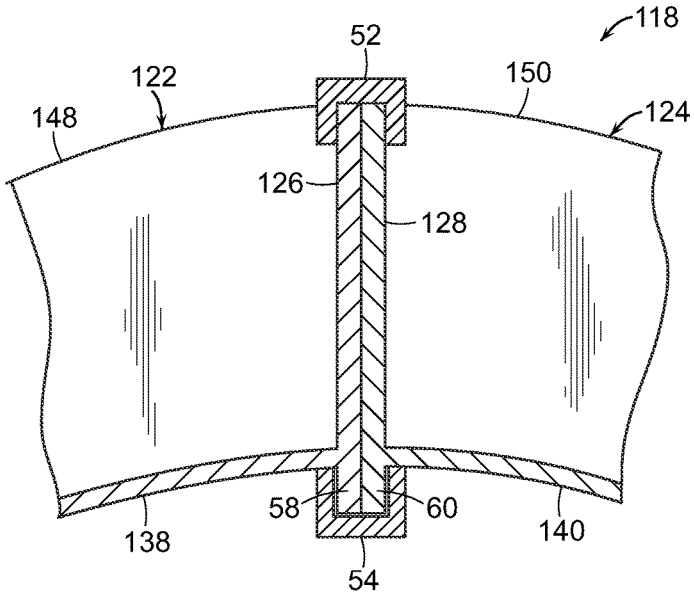
FIG. 6 is a view like FIG. 4, showing a chamber embodiment where C channels hold the mated half chambers to each other.
Figure 7:
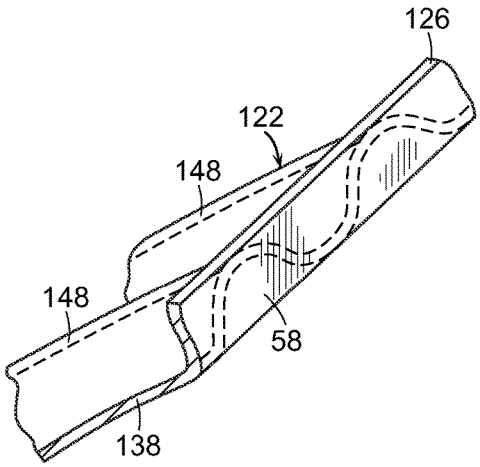
FIG. 7 is a partial perspective view of the top end of a half chamber, like that shown in FIG. 6.
Figure 8:
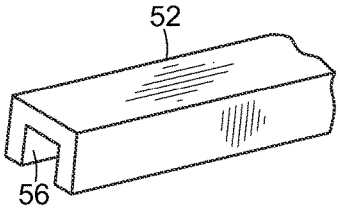
FIG. 8 is a perspective view of a channel which may be used to hold to half chambers together at a top joint.

FIG. 6 is a view like the view of FIGS. 4 and 5, showing a portion of another embodiment of the invention, chamber 118. Mating half chambers 122, 124 have respective peak corrugations 148, 150 and valley corrugations 138, 140. The half chambers 122, 124 meet at lengthwise flanges 126, 128. FIG. 7 is a partial view of the upper end of a half chamber 122, showing that flange 126 is preferably continuous, as is flange 128. In variations on this embodiment, the flanges may be intermittent as shown in connection with FIG. 3. Referring again to FIG. 6, lengthwise vertical lips 58, 60 run along the undersides of valleys 138, 140. The lips 58, 54 and the upper ends of flanges 126, 128 are respectively clamped together by channels 52, 54. FIG. 8 is a perspective view of typical channel 52 which is preferably made of a metal or fiber reinforced plastic. The width of channel 52 is dimensioned so that there is an elastic force in the channel when the clamp is forcibly engaged (as with a rubber hammer) with the mated flanges 126, 128. Channel 54 is similarly dimensioned with respect to the vertical lips 58, 60.

Figure 6A:
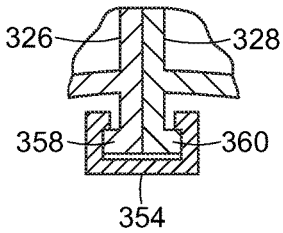
FIG. 6A is a partial detail of a variation on the joint shown in FIG. 6.

FIG. 6A is a detail of a portion of an alternative embodiment of the joint shown in FIG. 6. Flanges 326, 328 correspond with flanges 126, 128. The lengthwise vertical lips 358, 360 are L shape in cross section, so that when mated as shown they present as a T shape cross section. Alternate embodiment channel 354 is C shape in cross section, so it is vertically captured in place by the T shape cross section.

Figure 6B:
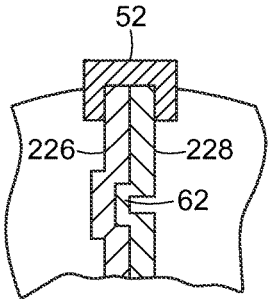
FIG. 6B is a partial detail of another variation on the joint shown in FIG. 6.

FIG. 6B shows another variation which may be used with the FIG. 6 embodiment and other embodiments. Vertical flange 226 has a recess and vertical flange 228 has a protuberance 62 which fits in the recess. The recess and protuberance may be round as shown in FIG. 3, or may comprise lengthwise running portions. In the chamber 118 and in other embodiments of the invention, the mating flanges may have even more contoured and interlocking features than have been shown by example.

Figure 9:
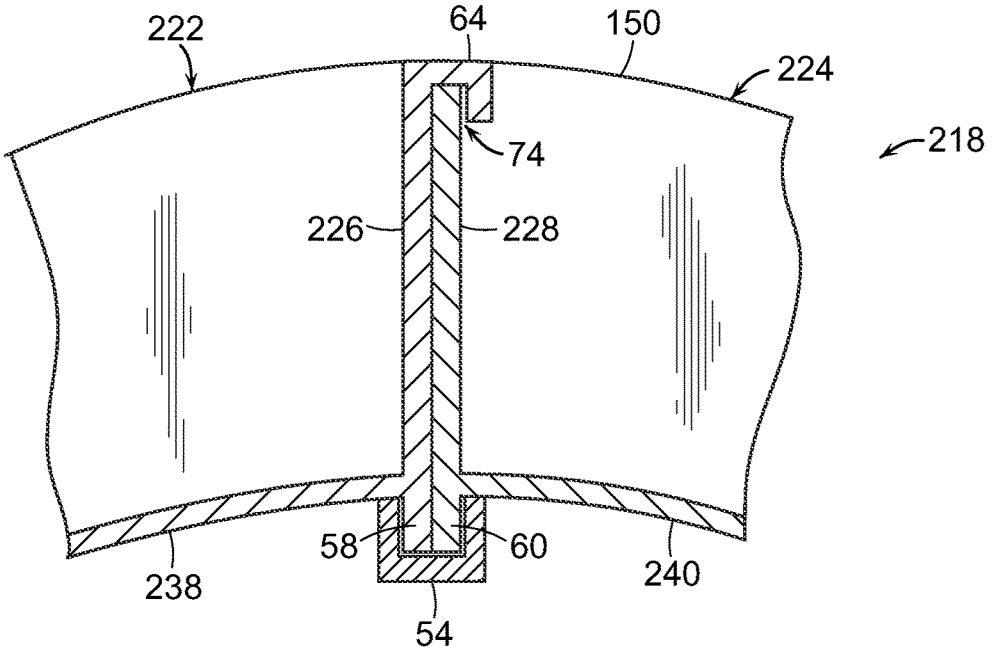
FIG. 9 is a view like FIG. 4 showing a joint comprising an integral J channel and a C channel clamp.

FIG. 9 is a vertical cross section like the view of FIG. 6, showing a portion of a chamber 218 comprised of half chambers 222, 224 having mating respective lengthwise vertical top flanges 226, 228, intermittent in valleys 238, 240. Alternately, the flanges are continuous. In the locations of the valleys, flange 226 has a top portion 64 shaped to create a pocket 74 within which is received the upper edge of flange 228. The upper part of flange 226 may be characterized as a J shape channel (which defines the pocket 74).

An optional way of securing two half chambers to each other comprises the use of locking rods. Reference may be made to the aforementioned application Ser. No. 14/025,773, which shows a longitudinal-running locking rod that is used to hold together half chambers that are connected to each other by a hinge top joint. The preferred half chambers of the present invention are mirror shape components, each of the other, as are the preferred half chambers of the Ser. No. 14/025,773 application. That makes the resultant chambers well-suited for assembly as overlapping end-to-end strings of chambers. The foregoing related application describes ways of making a multiplicity of identical half chamber precursors, which precursors are then modified, as by cutting, to form the desired mirror shape half chambers. Such methods for making mirror half chambers, which substantially reduce the cost of molds, may be used in the present invention. Alternatively, separate molds, or molds with moving parts, as also described in the related application, may be used.

Figure 11:
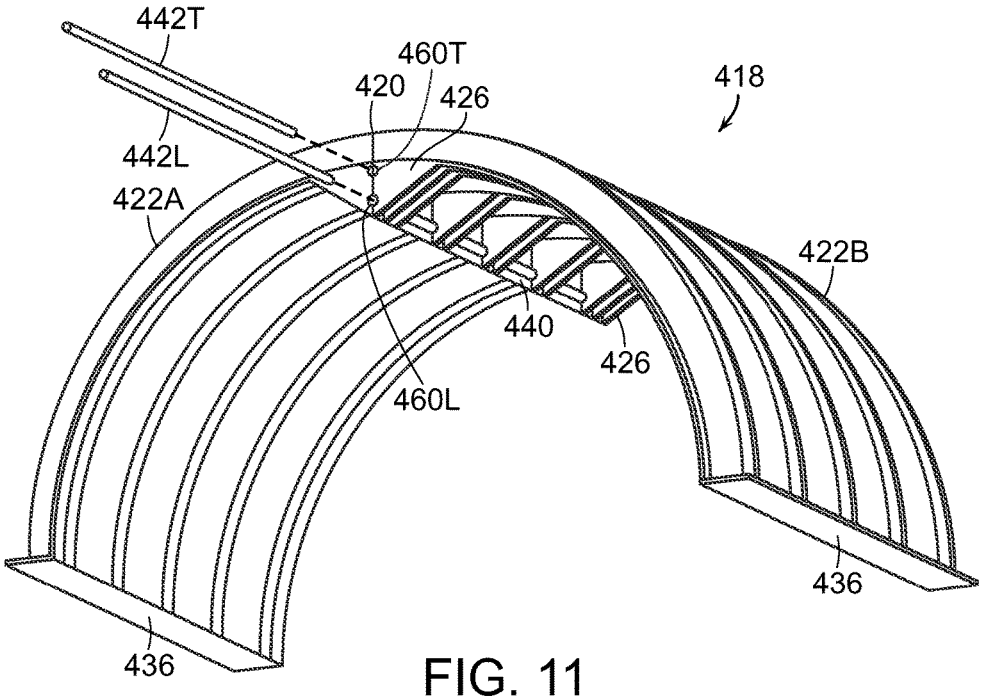
FIG. 11 is a partial perspective view of a chamber made of separately formed half chambers which are held together by a joint feature which comprises two locking rods.

As shown in the perspective view of FIG. 11, chamber 418 has opposing side base flanges 436 and comprises two mated half chambers 422A, 422B that meet at lengthwise joint 420. Mating vertical flanges 440, which comprise stirrup portions 441, described below, abut joint 420. A plurality of spaced apart ribs 426 run within the inner concavity of each half chamber to provide strength to each vertical flange 440 by connecting the flange to the underside of the arch curve of the half chamber. The half chambers are secured to each other by means of lengthwise-running locking rods 442T and 442L which run through the stirrups. In FIG. 11, the rods are shown as they are about to be respectively inserted into lengthwise openings 460T, 460L. While examples of chambers having dual passageways and associated locking rods are pictured here, in the generality of the invention only one passageway may be present and one locking rod will be used. In the exemplary chamber of FIG. 11 and FIG. 12, the passageways and locking rods are positioned below the elevation of the lower surfaces of the valley corrugations 432 at the top portion of the chamber, which surfaces face downwardly toward the base of the chamber.

Figure 12:
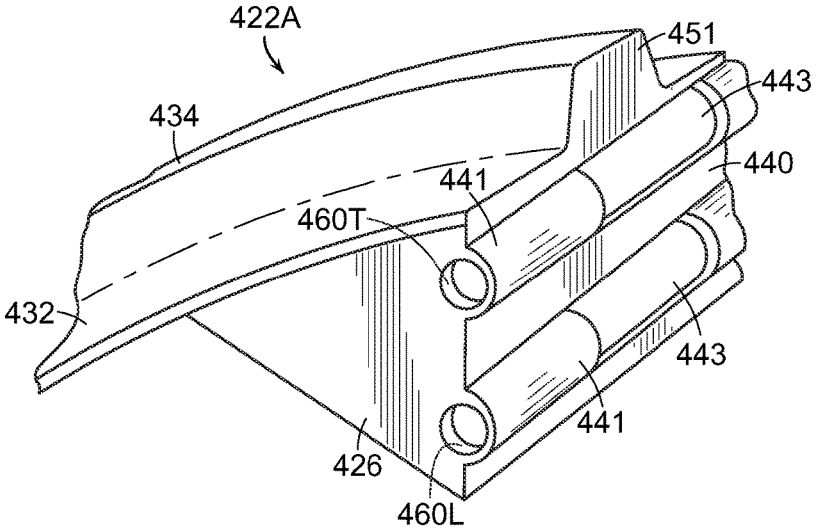
FIG. 12 is a partial view of the joint feature region of one of the half chambers shown in FIG. 11.
Figure 13:
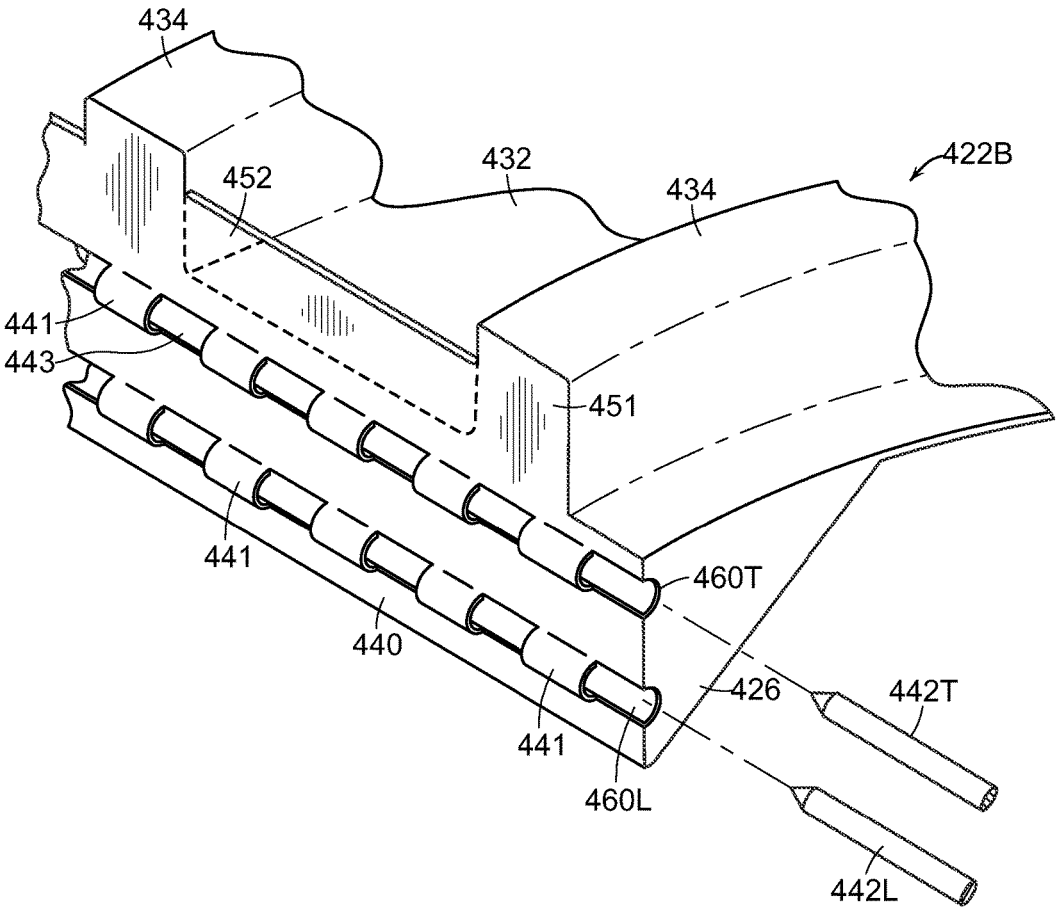
FIG. 13 is a view of the joint feature region of a half chamber very much like that shown in FIG. 11, where there is a continuous flange running between the peaks.

FIG. 12 and FIG. 13 are different views of fragments of the mating surfaces of the half chambers 422A, 422B. Portions 451 of the vertical flanges 440 extend upwardly into the concavity of a peak corrugation 434; other portions 452 extend downwardly below the elevation of the valley corrugations 432. There is a plurality of essentially semicircular cylindrical arches, called stirrups 441. Stirrups 441 are spaced apart from each other by slots 443, along the length of the half chamber, and in particular, along the length of flange 440. Slots 443 of one half chamber vertical flange are shaped to receive the stirrups 441 of the mating half chamber.

Figure 14:
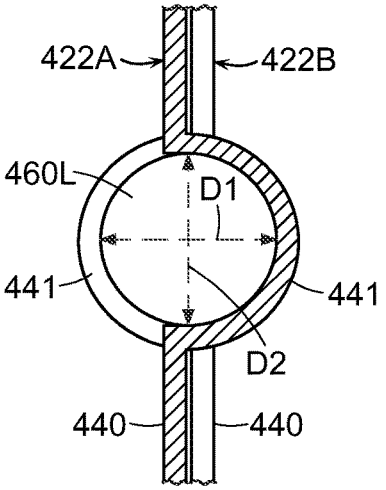
FIG. 14 is an end view in partial cross section, showing how a stirrup of one half chamber mates with the stirrup of another half chamber.

FIG. 14 is a schematic end view of the stirrup portions of the vertical flanges 440 of two mated half chambers, illustrating how the stirrups 441 of each half chamber form one of a plurality of circular openings, which openings are spaced apart along the length of the chamber and aggregate to define representative passageway 460L. As illustrated in FIG. 11 and FIG. 13, a locking rod 442T, 442L is slidable lengthwise along the length of each passageway 460T, 460L, thereby to effect locking of the mated stirrups 441 and associated flanges 440. The half chambers are thus prevented from separating at the joint. The opening has at vertical dimension D1 and a horizontal dimension D2 which are equal when the opening is circular, or which may be somewhat different when the opening is non-circular.

Figure 15:
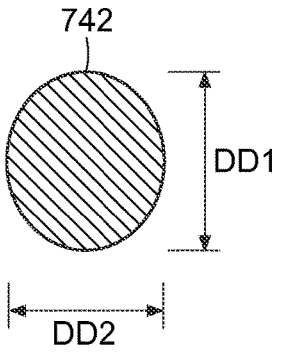
FIG. 15 is a cross section view of a locking rod which has an oblong cross section.
Figure 16:
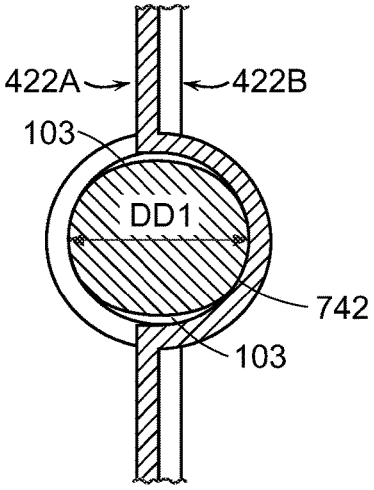
FIG. 16 is a view like FIG. 14, showing the rod of FIG. 15 after it has been put in place an rotated so the large axis of the oblong cross section forces the stirrups apart.

In one embodiment of the invention, the locking rod, which may be made of corrosion resisting metal or of sufficiently strong plastic material, may be round. In another embodiment of the invention, the rod may have a non-round (e.g., oblong) shape cross section. FIG. 15 shows a cross section of a portion of locking rod 742 which is elliptical, having a major diameter DD1 and a minor diameter DD2. In the FIGS. 15, 15A, and 16, the extent of non-roundness of the locking rod is greatly exaggerated for purpose of illustration. FIG. 16 is like FIG. 14, showing the addition of rod 742 which has been placed within the opening 460L that is defined by the two adjacent stirrups 441. With reference to FIG. 14-15, in the FIG. 16 embodiment, the dimension D2 of the opening 460L is by design larger than the dimension D1; and the dimension DD1 of the rod is slightly larger than dimension DD2 of the rod. The rod dimension DD1 slip fits into the opening having dimension D2. After having been slipped lengthwise into the opening, the locking rod 742 is rotated so the greater axis DD1 is made horizontal, as pictured in FIG. 16. Thus, stirrups 441 have been thrust apart, and that has drawn the flanges 422A, 422B toward one another. A resultant small spaces 103 are adjacent the top and bottom of the locking rod cross section, as can be seen in FIG. 16.

Figure 15A:
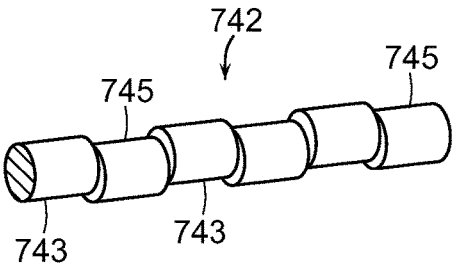
FIG. 15A is a perspective view of a locking rod having oblong cross section segments which are offset from each other.

FIG. 15A is a perspective view of a portion of a locking rod 742, showing how there is a first set of segments 745 that are offset in one direction and a second alternated set of segments 743 that are offset in the opposite direction. The alternating offsets of the segments 743, 745 accommodates that the stirrups on one half chamber alternate with the stirrups on the other half chamber, and that each half chamber's stirrups are to be moved in the opposite direction to those of the other half chamber. It will be appreciated that, relative to an imaginary lengthwise central axis of rotation of a rod 742, each segment will be offset, and thus could be called a cam.

The above-described rotation of the rod can be called "camming" the rod. A locking rod may be configured with means such as a pin or latch, not shown, to prevent the locking rod from rotating out of its desired cammed position. Alternative shapes of rod may be employed to effect camming within the general principle of this aspect of the invention.

Figure 17:
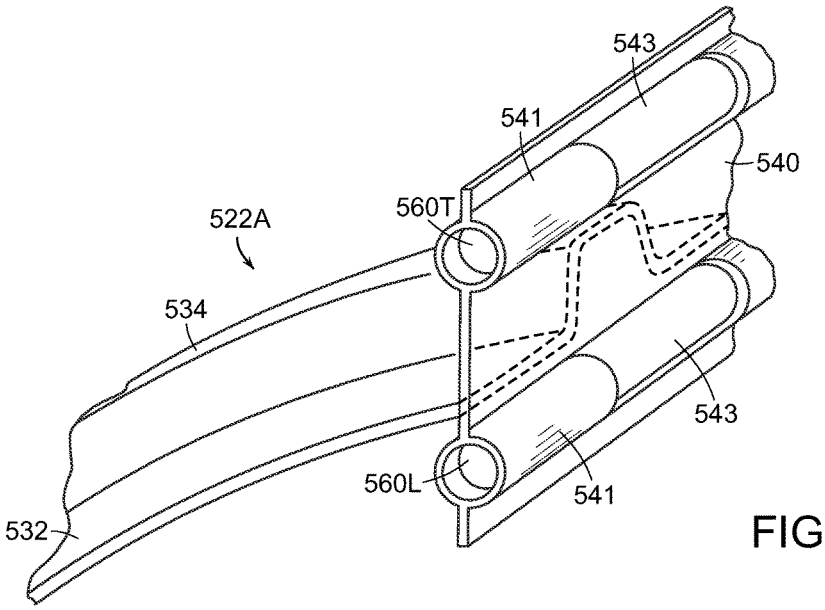
FIG. 17 is a view like FIG. 12, showing a joint feature where one locking rod is above the peaks, on the outside of the chamber, and the other locking rod is below the valleys, on the inside of the chamber.

FIG. 17 shows the upper portion of alternative embodiment half chamber 522A, which is shaped to mate with a mirror half chamber. A first set of alternating stirrups 541 and slots 543 run along the length of flange 540 and are configured to mate with the stirrups and slots of a mirror half chamber as described above. The first set of stirrups form a first passageway 560L which is lower in elevation than is the elevation of the lowermost portions or surfaces of peaks 534 or valleys 532 at the top of the chamber. (The reference point for elevation is the plane of the base flanges, not shown.) A second set of stirrups 541 and slots 543 forms a second passageway 560T. The stirrups 541 and slots 543 are arranged along the length of flange 540 at an elevation that is higher than that of the top (surfaces) of the peaks 534 of the half chamber 522A.

In the embodiments of FIGS. 12 and 13, the vertical flanges 440 are continuous along the length of the half chambers and flange portions 451 extend upwardly into the space which is at the upper end of each peak corrugation 434. In an alternative embodiment half chamber, a multiplicity of smaller discontinuous stirrup plates may be spaced apart along the length of the half chamber. In another alternative embodiment of the invention, only one locking rod may be used, for instance only the rod 442T may be present in the half chamber embodiment shown in FIG. 13. In still another alternative embodiment half chamber, there may be more than two passageways defined by stirrups, with associated more than two locking rods. In the exemplary chambers described thus far, locking rods are centered on the joint between the half chambers.

Figure 18:
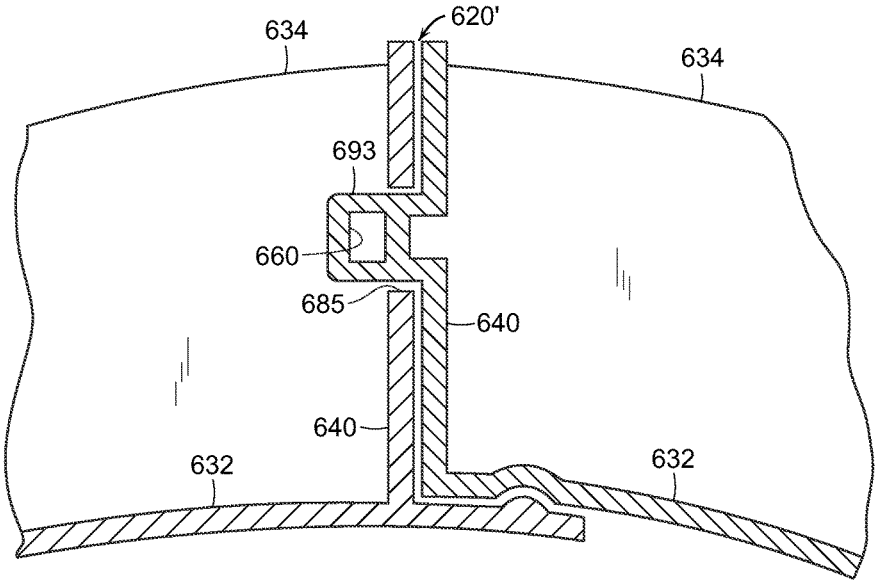
FIG. 18 is a vertical cross section view similar to that of FIG. 4, showing how a nub of one half chamber passes through an opening in the flange of a mating half chamber, so that a locking rod may hold the nub within the opening.

FIG. 18 shows portions of two half chambers 634, as they mate at the joint 620. Each half chamber has a multiplicity of tabs 693 which alternate in valleys along the length of the half chamber with a multiplicity of slots 685, at the vertical flange 640. Each tab 693 is received in a slot 685 of the mating half chamber. Each tab has a horizontal opening 660 through which a pin (locking rod, not shown) may be passed, to keep the tab from withdrawing through the slot, thus to hold the vertical flanges 640 in intimacy. Each locking rod may be short, so it can be inserted within the tab in a single-valley tab. In an alternative embodiment, not shown, each peak corrugation has a hole so that a locking rod may be passed along the whole length of the chamber, to engage a plurality of tabs 693. As is evident, the locking rod is not centered on the joint in this embodiment.

While a single locking rod having the nominal length of the chamber is preferably inserted in each lengthwise passageway that is defined by a plurality of stirrups in vicinity of the joint region, in an alternate embodiment the invention, a locking rod having a length which is half that of a chamber may be inserted from each end of the chamber.

While the joint between the above described half chambers having locking rods is formed at the vertical center plane of the exemplary chambers thus far described, in alternate embodiments of the invention the vertical flanges and the associated joint (and passageway and locking rod, when present) may be offset transversely somewhat from the center plane.

Half chambers may have other features that are used in combination with stirrups, passageways, and locking rod, to enhance the quality of the joint between half chambers. For example, there may be at the joint region one or more of (i) a plurality of fasteners, (ii) a plurality of C shape cross section clips, (iii) a plurality of mating bosses and recesses, and combinations thereof.

Figure 10:
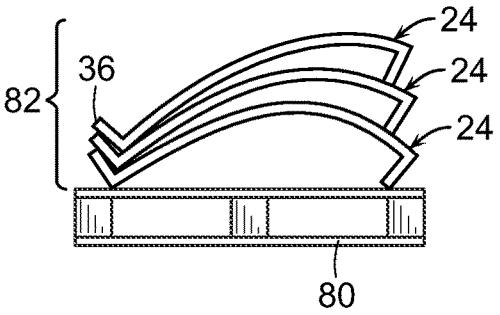
FIG. 10 is a semi-diagrammatic illustration of half chambers mounted on a pallet for shipping to an assembly point.

With reference to FIG. 10, in a method of making, shipping and installing chambers, half chambers (with or without a locking rod feature) may be shipped on a pallet 80 as a nested stack 82 as shown (for representative half chambers 24). The term "pallet" shall comprehend functionally equivalent devices. Typically, a pallet will be carried by a semi-trailer connected to a motor vehicle truck tractor, more generally, a transport vehicle, to a point of assembly which may be a job site or a location remote from the machine where the half chambers are molded, including within the same factory.

The following more completely recites the process. A method of manufacturing and transporting injection molded plastic corrugated chambers, for receiving water when buried beneath the surface of the earth, comprises the following. Each chamber has a length, opposing side base flanges running lengthwise and lying in a base plane, an arch shape wall running upwardly to a chamber top from the opposing side base flanges. The wall defines an arch shape cross section chamber interior and is characterized by alternating peak corrugations and valley corrugations running transverse to the chamber length. There is a lengthwise vertical center plane running intersecting the chamber top. The process comprises:

(a) molding, preferably by injection, a multiplicity of first half chambers and second half chambers. Each half chamber comprises one of said base flanges, about half of said arch shape wall, and a coupling portion connected to the half wall in vicinity of the top of the to-be-formed chamber. The coupling portions are shaped for mating first half chambers with second half chambers at a joint, to form whole chambers. Preferably the mated portions of the half chambers are configured to define a passageway, for receiving one or more locking rods;

(b) Placing the first half chambers and the second half chambers in nested fashion on a pallet or directly on a transport vehicle, transporting the pallets containing the half chambers on a transport vehicle, for example a truck, to a point of assembly.

(c) Removing the half chambers from the pallet or vehicle at the point of assembly and de-nesting the half chambers.

(d) Providing at least one locking rod for each two half chambers when the two mated half chambers are configured to define one or more lengthwise passageways.

(e) Mating the coupling portion of each first half chamber with and to the coupling portion of each second half chamber, thereby to form a multiplicity of whole chambers.

(f) Securing the mated half chambers to each other, by means which optionally include one or more of welding, fastening, and inserting of one or more lengthwise locking rods.

(g) Placing each whole chamber within a cavity in the soil or other water permeable natural or artificial substance, for use.

The invention enables more compact, and therefore more economic, storage and shipping of unassembled half chambers, compared to whole chambers. The invention also enables fabrication of large chambers which are beyond the plastic-weight molding capacity of, or the platen size of, a particular injection molding press.

The invention, with explicit and implicit variations and advantages, has been described and illustrated with respect to several embodiments. Those embodiments should be considered illustrative and not restrictive. Any use of words which relate to the orientation of an article pictured in space are for facilitating comprehension and should not be limiting should an article be oriented differently. Any use of words such as "preferred" and variations thereof suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A method of manufacturing, transporting and assembling a multiplicity of molded plastic corrugated chambers adapted for receiving water when buried beneath the surface of the earth, wherein each chamber has a length, opposing side base flanges running lengthwise and lying in a base plane, an arch shape wall running upwardly to a chamber top from the opposing side base flanges, a lengthwise vertical center plane that intersects the chamber top, the arch shape wall demarking an arch shape cross section chamber interior and characterized by alternating peak corrugations and valley corrugations running transverse to the chamber length, which method comprises:

(a) molding a multiplicity of first half chambers and a multiplicity of second half chambers, each half chamber comprising one of said base flanges, a half wall that is about one-half of said arch shape wall, and a coupling portion connected to said half arch shape wall in vicinity of the top of the chamber that is formed when a first half chamber is mated with a second half chamber;

wherein the coupling portion of each first half chamber is shaped for mating with the coupling portion of each second half chamber at a joint region of a chamber;

wherein each coupling portion comprises a multiplicity of stirrups; wherein each stirrup has the shape of an essentially semi-circular arch; and wherein the stirrups of mated half chambers form one or more lengthwise passageways shaped for receiving one or more locking rods when a first half chamber and second half chamber are mated;

(b) placing said multiplicities of first half chambers and second half chambers on a transport vehicle in nested fashion, and transporting the half chambers on the transport vehicle to a point of assembly;

(c) un-nesting and removing the half chambers of said multiplicities from the transport vehicle;

(d) mating the coupling portion of each first half chamber with and to the coupling portion of each second half chamber to form a chamber having a joint region;

(e) providing one or more locking rods for each chamber formed by step (d);

(f) securing each first half chamber to the second half chamber with which it is mated by inserting a locking rod lengthwise into each of said one or more lengthwise passageways, thereby to secure the half chambers to each other in proximity to said joint region.

2. The method of claim 1 further comprising: (g) placing each chamber within a cavity in soil or other substance for use.

3. The method of claim 1 wherein during step (f) the coupling portion of each first half chamber is further secured to the coupling portion of each second half chamber by a one or more of (i) a plurality of fasteners, (ii) a plurality of C shape cross section clips, and (iii) a plurality of mating bosses and recesses.

4. The method of claim 3 wherein the coupling portion of a first half chamber comprises a serpentine lip running lengthwise at the top of a first half chamber, the lip following the contour in the vertical plane of said alternating peak corrugations and valley corrugations.

5. The method of claim 1 wherein a locking rod provided in step (e) comprises one or more lengthwise segments having a non-round cross section, and wherein step (f) further comprises: rotating said locking rod after the locking rod is inserted into the lengthwise passageway, to thereby cause the coupling features of the mated half chambers to draw the half chambers close to each other at the joint region.

6. A plastic chamber adapted for receiving water when buried beneath the surface of the earth, wherein each chamber has a length, opposing side base flanges running lengthwise and lying in a base plane, an arch shape wall running upwardly to a chamber top from the opposing side base flanges, a lengthwise vertical center plane that intersects the chamber top, the arch shape wall demarking an arch shape cross section chamber interior and characterized by alternating peak corrugations and valley corrugations running transverse to the chamber length; the chamber comprised of:

a first half chamber mated to a second half chamber at a joint region in proximity to the top of the chamber by mating coupling portions of the half chambers, the chamber having at least one lengthwise-running locking rod in proximity to said joint region;

wherein each half chamber comprises a base flange which is one of said base flanges of the plastic chamber, a half wall that is about one-half of said arch shape wall, and, a coupling portion connected to the half wall; wherein the coupling portion comprises a multiplicity of stirrups spaced apart by slots along the length of the half chamber; and wherein each stirrup has the shape of an essentially semi-circular arch;

wherein the stirrups of the first half chamber are positioned within the slots of the second half chamber, and wherein the stirrups of the two mated half chambers define at least one lengthwise passageway proximate the top of the chamber; and, wherein said at least one locking rod is positioned within said at least one lengthwise passageway.

7. The chamber of claim 6 wherein the multiplicity of stirrups and slots are arranged to define two lengthwise passageways in proximity to the top of the chamber.

8. A molded plastic chamber comprised of two half chambers mated to each other by coupling features thereof and a locking rod, for receiving water when buried beneath the surface of the earth, the chamber having a length, opposing side lengthwise-running base flanges, and an arch wall running from one base flange to the top of the chamber and then to the other base flange, the arch wall having peak corrugations and valley corrugations running transverse to the chamber length;

each half chamber having a length and comprising one of said lengthwise-running base flanges, about half of said corrugated arch wall, and a coupling feature;

the coupling features of the two half chambers mated and secured to each other at a lengthwise joint region in vicinity of the top of the chamber, and each coupling feature comprising a first multiplicity of stirrups and slots spaced apart lengthwise wherein each stirrup has the shape of an essentially semi-circular arch;

wherein each stirrup is positioned within a said slot of the mating half chamber; and, wherein the two stirrup multiplicities of the mated half chambers form at least one lengthwise passageway; and, wherein said locking rod is positioned within said at least one lengthwise passageway, for keeping stirrups positioned with said slots, thereby securing the coupling features of the half chambers to each other.

9. The chamber of claim 8 wherein the coupling feature of each half chamber further comprises: a continuous or segmented vertical flange running lengthwise in said lengthwise joint region.

10. The chamber of claim 9 wherein the vertical flanges of the mated half chambers are secured to each other by one or more of (i) a plurality of fasteners, (ii) a plurality of C-shape cross section clips, and (iii) a plurality of mating bosses and recesses.

11. The chamber of claim 9 wherein the vertical flange of one of the mated half chambers comprises a serpentine lip running lengthwise at the top of the half chamber, the lip following the contour in the vertical plane of said alternating peak corrugations and valley corrugations.

12. The chamber of claim 8 wherein each half chamber coupling feature further comprises a second multiplicity of stirrups and slots spaced apart lengthwise; wherein each second multiplicity stirrup is positioned within a slot of the second multiplicity slots of the mating half chamber; the two stirrup second multiplicities of said mated half chambers forming a second lengthwise passageway which is vertically spaced apart from the first lengthwise passageway; and, wherein the chamber comprises a second locking rod positioned in the second lengthwise passageway.

13. The chamber of claim 12 wherein the vertical flanges of the mated half chambers are secured to each other by one or more of (i) a plurality of fasteners, (ii) a plurality of C-shape cross section clips, and (iii) a plurality of mating bosses and recesses.

14. The chamber of claim 12 wherein the first passageway is at an elevation which is higher than the elevation of the uppermost portions of said peak corrugations at said lengthwise joint region.

15. The chamber of claim 12 wherein the second passageway is at an elevation which is lower than the lowermost portions of said valley corrugations at said lengthwise joint region.

16. The chamber of claim 12 wherein the locking rod comprises one or more lengthwise segments having a non-round cross section, and wherein the locking rod is turnable within said lengthwise passageway to draw the mated coupling features toward one another.

17. The chamber of claim 12 wherein the lengthwise passageway has an oblong shape bore.

* * * * *